United States Patent [19]

Satsumabayashi et al.

[11] 3,973,951

[45] Aug. 10, 1976

[54] HIGH TOUGHNESS AND WEAR-RESISTANCE STEEL

[75] Inventors: Kazuyoshi Satsumabayashi, Nagaokakyo; Kiyoshi Mano, Hirakata, both of Japan

[73] Assignee: Kabushiki Kaisha Komatsu Seisakusho, Leverkusen, Japan

[22] Filed: Feb. 11, 1975

[21] Appl. No.: 548,992

[30] Foreign Application Priority Data

Feb. 12, 1974 Japan ..... 49-16268

[52] U.S. Cl. ..... 75/126 Q; 148/36

[51] Int. Cl.[2] ..... C22C 38/34

[58] Field of Search ..... 75/126 Q; 148/36

[56] References Cited

UNITED STATES PATENTS 1,915,064 6/1933 Malcolm ..... 75/126 Q

*Primary Examiner*—Arthur J. Steiner

*Attorney, Agent, or Firm*—Armstrong, Nikaido & Wegner

[57] ABSTRACT

A high toughness and wear-resistance steel consisting, by weight percent based R weight of the steel, of 0.25 to 0.38 of carbon, 1.60 to 2.60 of silicon, 0–0.8 of manganese, 0–0.3 of phosphorus, 0–0.3 of sulphur, 3.0 to 6.0 of chromium and the balance of Fe. The steel is mainly used as an excavating tool edge material for construction machines.

3 Claims, 1 Drawing Figure

HIGH TOUGHNESS AND WEAR-RESISTANCE STEEL

BACKGROUND OF THE INVENTION

1. Field of the Invention

This invention relates to an improvement in a high toughness and wear-resistance steel, and more particularly to an improvement in a high toughness and wear-resistance steel used as an excavating tool edge material for construction machines.

2. Description of the Prior Art:

Hitherto, it is well known that a tool edge material should be used in construction machines, such as, for example, bulldozers, power shovels, etc., as excavating soil, sand and rock requires high toughness and hardness. For example, when a hard rock having more than 3000 m./sec. of elastic wave velocity is excavated, the wear-resistance steel having more than 5 Kg./cm.$^2$ of toughness by Charpy impact value and more than 50 $H_RC$ of hardness is required. However, when excavating such hard rock with an excavating tool edge of such wear-resistance steel, there has been an inconvenience such that the excavating tool edge is heated by the friction with the rock to about 500°C, and the steel is subjected to a tempering, thereby extremely decreasing the hardness thereof. In order to remove the above described inconvenience, the employment of an alloy steel consisting of C, Si, Mn, Cr, Mo, B and Fe has been considered. However, the alloy steel consisting of such components has had a disadvantage that the wear-resistance property thereof is significantly decreased when a hard rock as having more than 3000 m./sec. of elastic wave velocity is cut or excavated by the alloy steel.

SUMMARY OF THE INVENTION

The present invention has been made for the purpose of eliminating the foregoing disadvantage and inconvenience of the prior art, and it is therefore an object of the present invention to provide a high toughness and wear-resistance steel consisting, by weight percent based on the weight of the steel, of 0.25-0.38 of C, 1.60-2.60 of Si, 0–0.8 of Mn, balance of 0–0.3 of P, 0–0.3 of S, 3.0–6.0 of Cr and a balance of Fe, thereby obtaining higher toughness and wear-resistance properties than those of the previously provided wear-resistance steels used for the excavating tool edge material for construction machines.

BRIEF DESCRIPTION OF THE DRAWINGS

The above and other objects, features and advantages of the present invention will become apparent from the following description taken in conjunction with the accompanying drawing, in which.

DETAILED DESCRIPTION OF THE PREFERRED EMBODIMENTS

Figure 1:
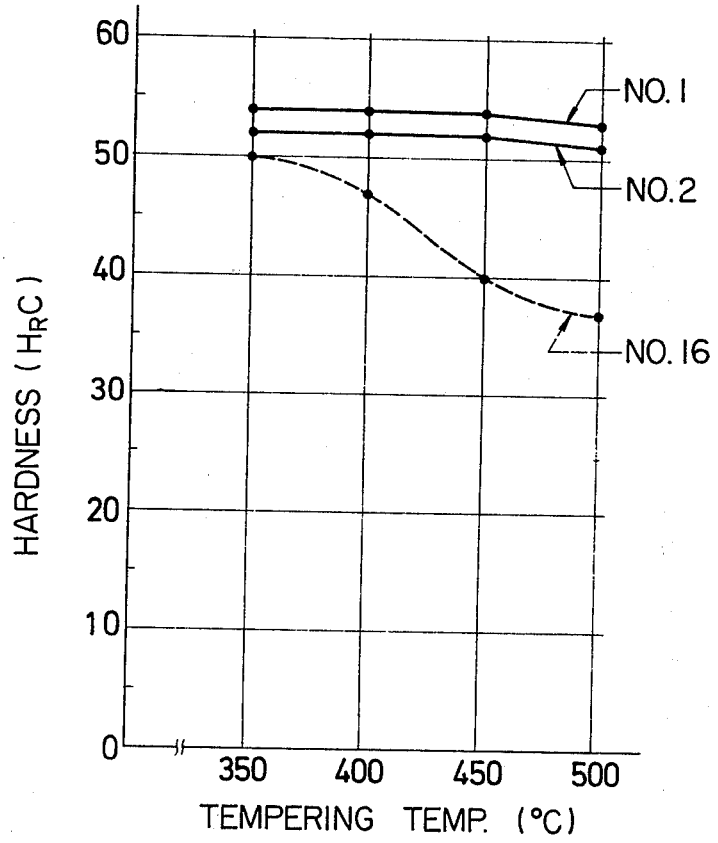
FIG. 1 is a graph showing the relationship between the tempering temperature and hardness of respective steels embodied by the present invention in comparison with that of a conventional wear-resistance steel.

Preferred embodiments of the present invention will now be described in detail with reference to the following Tables and the accompanying drawing.

Generally, in order to maintain the hardness necessary for a wear-resistance steel, carbon content of at least 0.25 wt.% based on the weight of the steel is necessitated. On the other hand, when the carbon content exceeds 0.38 wt.%, the toughness of the steel will be deteriorated. Therefore, the content of C is in the range of 0.25–0.38 wt.%.

Silicon and chromium are elements to delay the softening of the steel due to a tempering of the steel. In steel where the carbon content thereof is in the above-mentioned range of 0.25 to 0.38 wt.%, in order to maintain more than 50 $H_RC$ of hardness after subjecting the steel to the tempering at 500°C, it is necessary that the steel contain more than 1.60 wt.%, based on the weight of the steel, of Si and more than 3.0 wt.%, based on the weight of the steel, of Cr. When Si and Cr are increased in their respective contents, the resistance to the softening due to the tempering of the steel is also increased. However, when Si and Cr contents respectively exceed 2.60 and 6.0 wt.%, the impact value of the steel will be significantly decreased. Therefore, Si is determined to be in the range of 1.60–2.60 wt.% and Cr 3.0–6.0 wt.%.

Meanwhile, the inclusion of manganese within the steel of the aforementioned composition is detrimental, because the impact value of the steel is also decreased. However, when Mn content does not exceed 0.8 wt.% based on the weight of the steel, almost no influence is exerted on the steel. Therefore, the Mn content is 0 – 0.8 wt.%.

Phosphorus and sulphur are also harmful elements for such steel because they decrease the impact value of the steel. Therefore, both are set as not exceeding 0.03 wt.% based on the weight of the steel so that almost no influence of P and S is exerted on the steel. Of course, in order to obtain higher impact value in such steel, minimizing of P and S contents in such steel to as little as possible is preferable.

The following Tables show examples of the present invention.

Table 1.

| Example No. | Composition (except a balanced Fe) (wt.%) | | | | | |
|---|---|---|---|---|---|---|
| | C | Si | Mn | P | S | Cr |
| 1 | 0.31 | 1.80 | 0.50 | 0.011 | 0.016 | 5.10 |
| 2 | 0.29 | 1.65 | 0.53 | 0.010 | 0.015 | 3.05 |
| 3 | 0.26 | 1.60 | 0.43 | 0.012 | 0.018 | 3.20 |
| 4 | 0.25 | 1.73 | 0.46 | 0.019 | 0.026 | 4.11 |
| 5 | 0.27 | 1.72 | 0.40 | 0.023 | 0.026 | 5.73 |
| 6 | 0.25 | 2.60 | 0.30 | 0.021 | 0.026 | 3.52 |
| 7 | 0.27 | 1.81 | 0.60 | 0.023 | 0.024 | 5.90 |
| 8 | 0.31 | 2.10 | 0.36 | 0.021 | 0.023 | 3.21 |
| 9 | 0.32 | 2.31 | 0.70 | 0.021 | 0.020 | 5.73 |
| 10 | 0.35 | 1.73 | 0.40 | 0.029 | 0.021 | 3.14 |
| 11 | 0.35 | 1.83 | 0.36 | 0.027 | 0.019 | 5.61 |
| 12 | 0.35 | 2.41 | 0.41 | 0.023 | 0.018 | 3.14 |
| 13 | 0.34 | 2.56 | 0.46 | 0.022 | 0.019 | 4.37 |
| 14 | 0.38 | 2.43 | 0.70 | 0.020 | 0.024 | 5.72 |

Table 2.

| Example No. | Condition of Heat Treatments | | Mechanical Characteristics | | | | |
|---|---|---|---|---|---|---|---|
| | Hardening Temp. (°C) | Tempering Temp. (°C) | Tensile Strength (Kg./mm²) | Elon-gation (%) | Reduction of Area (%) | Impact Value by Charpy (Kg. m./cm.hu 2) | Hard-ness ($H_RC$) |
| 1 | 950 | 400 | 186 | 11.3 | 36 | 6.1 | 52 |
| 2 | 950 | 400 | 172 | 13.6 | 41 | 5.9 | 51 |
| 3 | 950 | 400 | — | — | — | 6.2 | 50 |
| 4 | 950 | 400 | — | — | — | 6.2 | 52 |
| 5 | 950 | 400 | — | — | — | 5.9 | 51 |
| 6 | 950 | 400 | — | — | — | 5.6 | 52 |
| 7 | 950 | 400 | — | — | — | 5.7 | 52 |
| 8 | 950 | 400 | — | — | — | 5.3 | 53 |
| 9 | 950 | 400 | — | — | — | 5.3 | 53 |
| 10 | 950 | 400 | — | — | — | 5.0 | 54 |
| 11 | 950 | 400 | — | — | — | 5.3 | 53 |
| 12 | 950 | 400 | — | — | — | 5.3 | 53 |
| 13 | 950 | 400 | — | — | — | 5.0 | 54 |
| 14 | 950 | 400 | — | — | — | 5.0 | 55 |

Table 3

| Comparative Example No. | Composition (except a balanced Fe)(wt.%) | | | | | | | |
|---|---|---|---|---|---|---|---|---|
| | C | Si | Mn | P | S | Cr | Mo | Ti |
| 15 | 0.40 | 2.86 | 0.90 | 0.020 | 0.025 | 6.01 | — | — |
| 16 | 0.30 | 1.64 | 0.51 | 0.010 | 0.016 | 0.60 | 0.003 | 0.015 |

Table 4.

| Comparative Example No. | Condition of Heat Treatments | | Mechanical Characteristics | |
|---|---|---|---|---|
| | Hardening Temp. (°C) | Tempering Temp. (°C) | Impact Value by Charpy (Kg.m./cm.²) | Hardness ($H_RC$) |
| 15 | 950 | 400 | 3.2 | 56 |
| 16 | 950 | 400 | — | 47 |

In the above described examples shown in Tables 1 to 4, examples 1 to 14 shown in Tables 1 and 2 belong to the high toughness and wear-resistance steel of the present invention. It is clearly shown from a comparative example 15 shown in Tables 3 and 4, that the impact value is significantly decreased when respective contents of C, Si, Mn and Cr are increased.

The accompanying Figure is a graph showing the relationship between tempering temperature and hardness of the examples 1 and 2, which belong to the high toughness and wear-resistance steel of the present invention as shown in Table 1, in comparison with that of a conventional wear-resistance steel as an excavating or cutting edge material as shown in Tables 3 and 4 by a comparative example 16.

As is clearly seen from the Figure, hardness of the high toughness and wear-resistance steel of the present invention is little decreased when the tempering temperature thereof is risen, while that of the conventional wear-resistance steel is extremely decreased in proportion to the rise of the tempering temperature thereof.

Thus, respective composition elements and their respective contents of the high toughness and wear-resistance steel of the present invention is determined as follows:

| | |
|---|---|
| Carbon: | 0.25 to 0.38 (wt.%) |
| Silicon: | 1.60 to 2.60 (wt.%), preferably 1.73–2.41 |
| Manganese: | 0 – 0.8 (wt.%) |
| Phosphorus: | 0 – 0.3 (wt.%) |
| Sulpher: | 0 – 0.3 (wt.%) |
| Chromium: | 3.0 to 6.0 (wt.%), preferably 3.14–5.73 |
| Fe: | remaining parts |

What is claimed is:

1. A high toughness and wear-resistance steel consisting of, by weight percent based on the weight of said steel, 0.25 to 0.38 of carbon, 1.60 to 2.60 of silicon 0 – 0.8 of manganese, 0 – 0.03 of phosphorus, 0 – 0.03 of sulphur, 3.0 to 6.0 of chromium and a balance of Fe.

2. A high toughness and wear-resistance steel as set forth in claim 1, wherein said silicon content is preferably in the range of 1.73 to 2.41% by weight based on the weight of said steel.

3. A high toughness and wear-resistance steel as set forth in claim 1, wherein said chromium content is preferably in the range of 3.14 to 5.73% by weight based on the weight of said steel.

* * * * *